United States Patent [19]

Wenzel

[11] Patent Number: 4,745,982

[45] Date of Patent: May 24, 1988

[54] ADJUSTABLE BENT SUB

[76] Inventor: Kenneth H. Wenzel, 3668-93 Street, Edmonton, Alberta, Canada, T6E 5N3

[21] Appl. No.: 935,735

[22] Filed: Nov. 28, 1986

[51] Int. Cl.[4] ..... E21B 7/08

[52] U.S. Cl. ..... 175/74; 175/62; 175/320; 166/237; 285/93; 285/184

[58] Field of Search ..... 175/61, 62, 73, 74, 175/75, 320; 166/237, 240; 285/93, 184, 282

[56] References Cited

U.S. PATENT DOCUMENTS

| | | | |
|---|---|---|---|
| 4,067,404 | 1/1978 | Crase | 175/75 |
| 4,077,657 | 3/1978 | Trzeciak | 175/61 |
| 4,220,214 | 9/1980 | Benoit | 175/74 |
| 4,286,676 | 9/1981 | Nguyen et al. | 175/320 |
| 4,303,135 | 12/1981 | Benoit | 175/73 |

*Primary Examiner*—Stephen J. Novosad
*Assistant Examiner*—Terry L. Melius
*Attorney, Agent, or Firm*—Hayes, Davis & Soloway

[57] ABSTRACT

An adjustable bent sub for use in directional drilling in earth formations comprises a first body member having a first body portion defining a first primary axis and a second body portion defining a first secondary axis disposed at a first offset angle with respect to the first primary axis, a second body member having a first body portion defining a second primary axis and a second body portion defining a second secondary axis disposed at a second offset angle with respect to the first primary axis, the second body member being adapted to be secured to the first body member such that the first secondary axis and the second primary axis are coaxial and define a common axis and the second body member is rotatable about the common axis. A device is provided for non-rotatably coupling the second body member to the first body member in predetermined angular relation about the common axis so as to provide a predetermined angular relationship between the first primary axis and the second secondary axis.

9 Claims, 4 Drawing Sheets

ADJUSTABLE BENT SUB

The present invention relates, in general, to directional drilling in earth formations and, more specifically, to an adjustable bent sub for use in directional drilling.

BACKGROUND OF THE INVENTION

"Directional drilling" is a procedure employed in the earth drilling industry when it is necessary to change the direction of a borehole. In essence, directional drilling is achieved by inserting, at the downhole end of a drill string, a small section of pipe, called as a "sub", which has been "bent" such that the longitudinal axis at one end its ends is at a slight angle, referred to herein as the "offset angle" to the longitudinal axis at the other end its ends. Such a tool is called a "bent sub".

In practice, a vertical borehole is drilled to a predetermined depth. The drill string is then withdrawn and a bent sub having the desired offset angle is inserted between the end of the drill string and the downhole motor. The drill string is then tripped back into the borehole. Since the longitudinal axis of the drill bit will now be at an angle to the original borehole, the direction of the bore hole will be altered. The bent sub may be replaced any number of times in order to provide a borehole of the desired shape and configuration.

The angular offset of the bent sub is conventionally achieved by physically bending the sub or by otherwise modifying the longitudinal axis of the sub during the machining stage of its manufacture. Since the angular offset is very small, in the neighbourhood of one or two degrees, accurate bends are relatively difficult to achieve. Further, in order to provide for selectivity, it is necessary to provide a series of bent subs having offset angles ranging from about $\frac{1}{4}$ of one degree in $\frac{1}{4}$ degree increments to about 2 degrees.

While this system is workable, it has a number drawbacks. First, existing bent subs are difficult and, therefore, expensive to construct accurately. Second, this difficulty is multiplied by the number of different bent subs necessary to provide the selection offset angles required. Third, it is necessary to replace one bent sub with another when a change borehole direction is required. This is relatively time consuming.

A still further drawback of conventional bent sub systems relates to the location of the bent sub in the drill string. It will be understood that the more remote the location of the bent sub from the drill bit, the greater the interference between the drill string and the borehole when tripping the drill string into the borehole. Thus, it is viewed as desirable to position the bent sub as close to the drill bit as possible in order to reduce friction caused by the scraping of the drill string against the borehole wall. The optimum positioning of the bent sub would be between the power unit and bearing components of the downhole motor. However, for various reasons, this is not possible with conventional bent subs and, as a result, it has been inserted between the power unit and the downhole end of the drill string. This reduces the maximum allowable offset angle and thus increases the number of bent subs changes required to achieve the desired borehole configuration.

SUMMARY OF THE INVENTION

The present invention seeks to provide a bent sub which overcomes the above described disadvantages of the prior art.

According to the present invention, there is provided an adjustable bent sub for use in directional drilling in earth formations comprising a first body member having a first body portion defining a first primary axis and a second body portion defining a first secondary axis disposed at a first offset angle with respect to the first primary axis, a second body member having a first body portion defining a second primary axis and a second body portion defining a second secondary axis disposed at a second offset angle with respect to the first primary axis. The second body member is adapted to be secured to the first body member such that the second primary axis and the first secondary axis are coaxial and define a common axis and the second body member is rotatable about the common axis. Means is provided for selectively non-rotatably coupling the second body member to the first body member in predetermined angular relation about the common axis so as to provide a predetermined angular relationship between the first primary axis and the second secondary axis.

BRIEF DESCRIPTION OF THE DRAWINGS

These and other features of the invention will become more apparent from the following description in which reference is made to the appended drawings, wherein.

DETAILED DESCRIPTION OF PREFERRED EMBODIMENT

Figure 1:
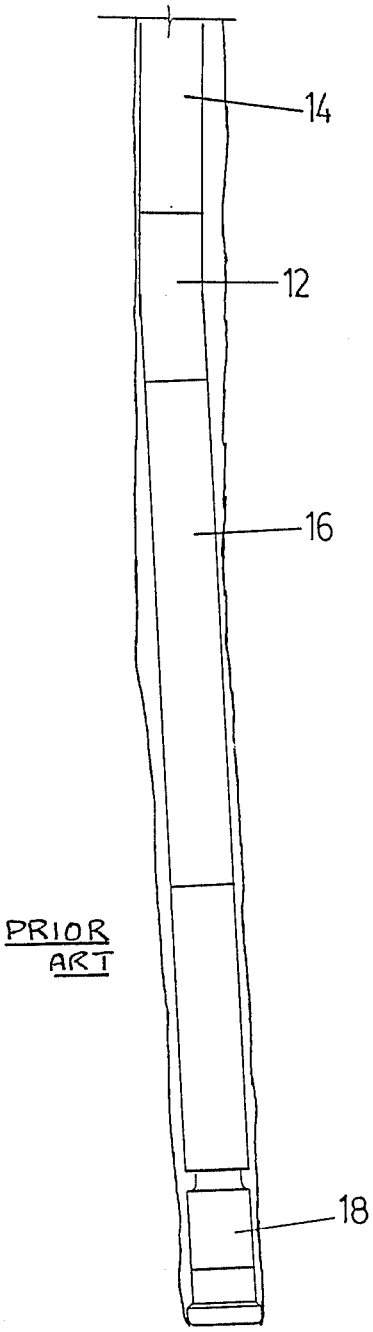
FIG. 1 is a partially broken view, of a drill string in a borehole illustrating a conventional bent sub arrangement.

FIG. 1 illustrates a conventional assembly employed for directional drilling in earth formations. The assembly includes a bent sub 12 threadedly engaged at its uphole end to the downhole end of a drill string 14 and threadedly engaged at its lower end to the uphole end of a downhole motor assembly 16. The lower end of the drilling motor assembly is secured to a drill bit 18. The bent sub is constructed so that the axis of its downhole end is disposed at an offset angle ranging from a fraction of one degree to about two degrees to the axis of its uphole end. This is typically achieved by physically bending the downhole end with respect to the uphole end. It will be understood that with the axis of the drill bit being angularly offset with respect to the axis of the drill string, it is then possible to alter the direction of the borehole. The magnitude of the angular deviation from the axis of the drill string may be altered by selecting a bent sub with the proper angular offset. Thus, it is conventional to maintain an inventory at the drill site a supply of bent subs having different offset angles so that when a new drilling direction is required, the drill string is withdrawn from the borehole and the bent sub is replaced with a bent sub having the appropriate offset angle. It will be understood that the construction of the bent sub must be exacting and is, therefore, relatively expensive, the maintenance of the inventory is expensive, and the replacement of an existing bent sub is relatively time consuming. In addition, prior art bent subs are located between the drill string and downhole motor and a review of the geometry involved indicates the maximum offset angle which can be provided without interference. The present invention seeks to provide a bent sub which overcomes these drawbacks of the prior art.

The present invention, generally designated by reference numeral 20, will be now be described with reference to FIGS. 2 to 5 where the same reference characters designate similar parts.

Figure 2:
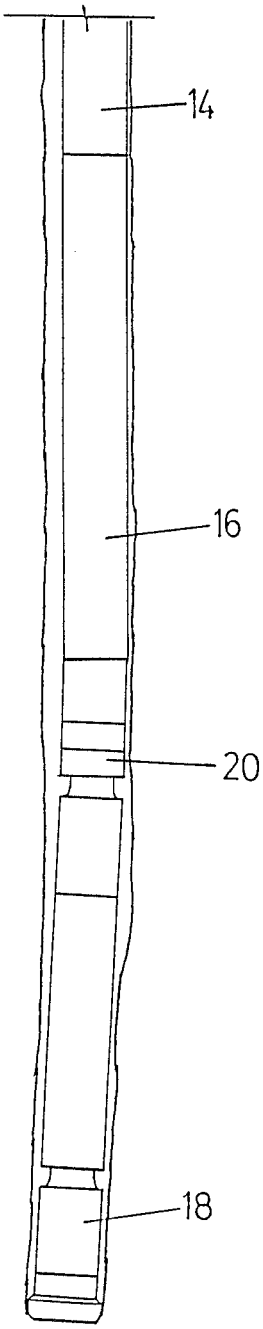
FIG. 2 is a view similar to FIG. 1 but illustrating an adjustable bent sub assembly according to the preferred embodiment of the present invention.

With particular reference to FIG. 2, the bent sub 20 of the present invention is disposed between a conventional downhole motor 16 and the bearing section of the downhole motor assembly. This location permits larger offset angles and/or reduces interference while running in the borehole. The bent sub of the present invention is constructed in such a manner that the offset angle can be easily adjusted between predetermined limits without removal of the sub from the drill string and thus renders unnecessary the maintenance of a large inventory of bent subs having different offset angles.

Figure 3A:
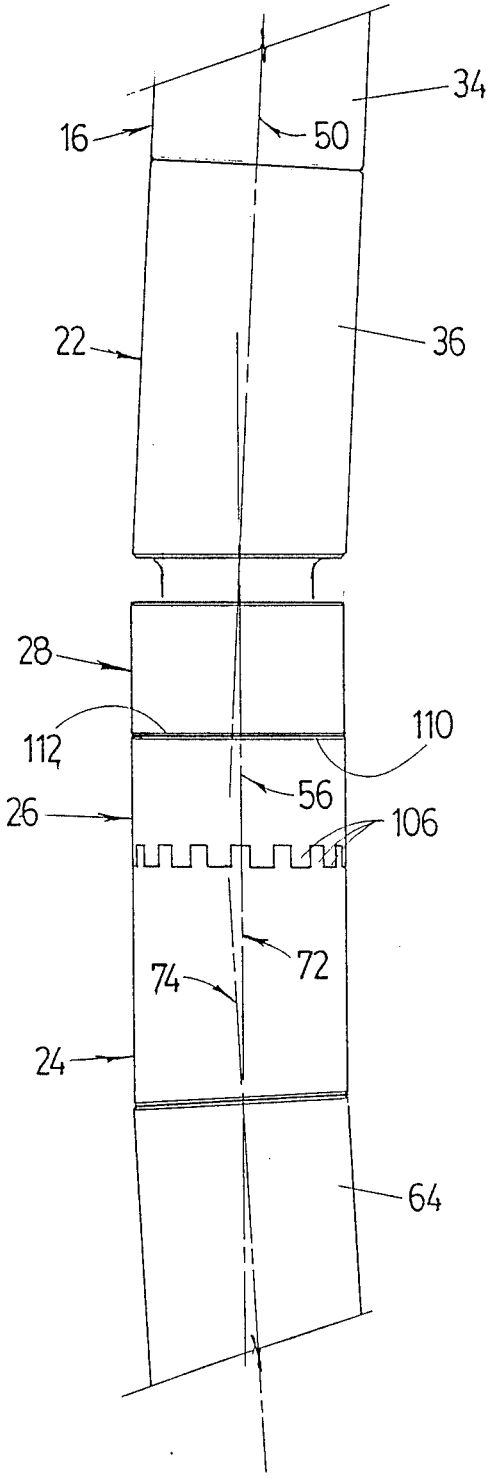
FIG. 3*a* is a partial broken, elevational view of a portion of a drill string illustrating the adjustable bent sub of the present invention at its maximum offset angle.
Figure 3B:
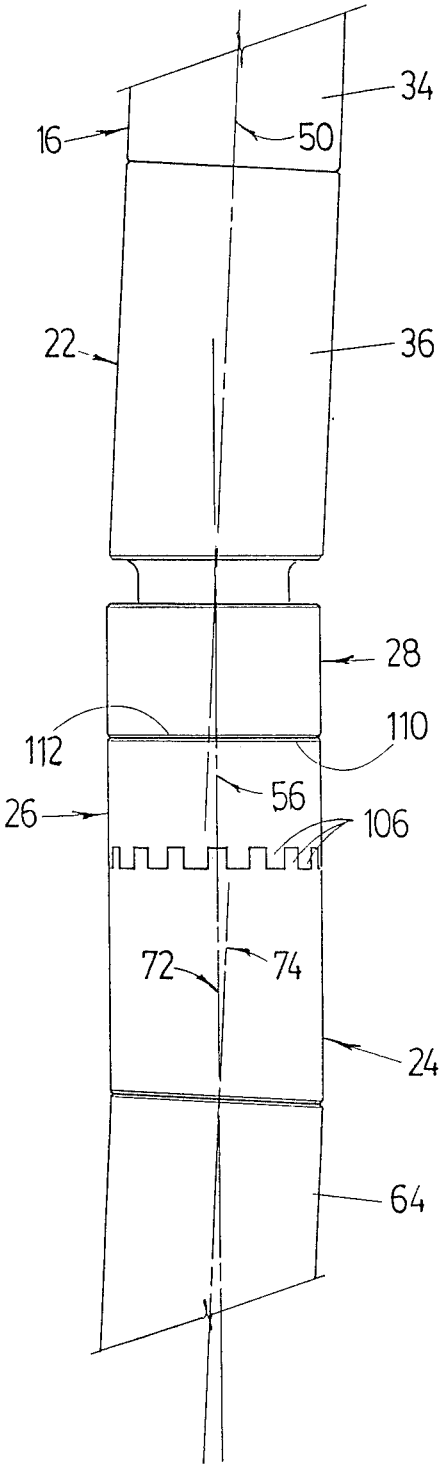
FIG. 3*b* is a view similar to FIG. 3*a*, but illustrating the bent sub of the present invention at its minimum offset angle.
Figure 4:
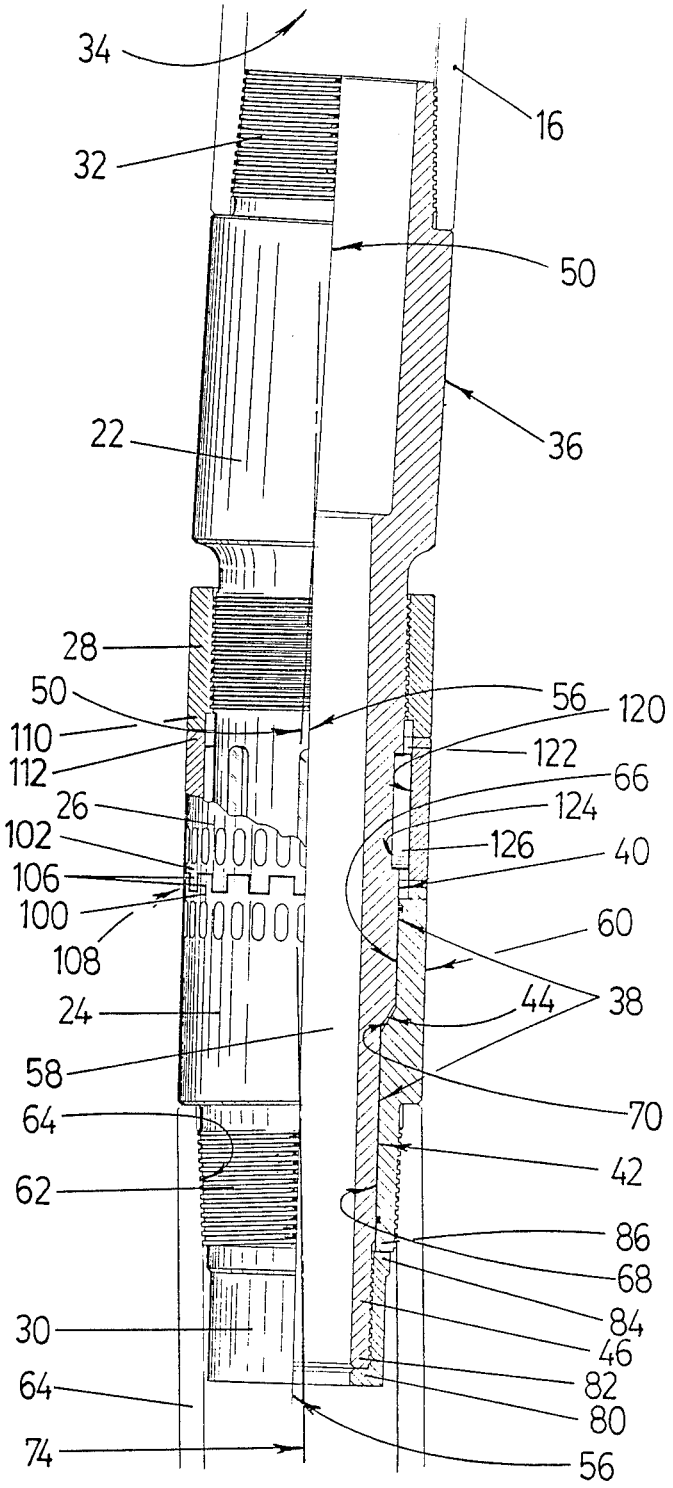
FIG. 4 is a view similar to FIG. 3*a* but in partial section illustrating the internal structure of the adjustable bent sub of the present invention.

With reference to FIGS. 3 and 4, bent sub 20 will be seen to be comprised of five components, namely, a mandrel 22, a bent sub housing 24, a sleeve 26 and a first nut 28 and a second nut 30.

Mandrel 22 is in the form of a pipe section having an externally threaded pin end 32 adapted to threadedly engage the bit end 34 of a conventional motor housing 16. The mandrel includes a first exterior surface portion 36 whose diameter is the same as that of the motor housing and drill string and a second exterior surface portion 38 having two portions 40 and 42 of reduced diameter. Reduced diameter portions 40 and 42 are separated by a conical shoulder 44. The downhole end 46 of the mandrel is externally threaded for threaded engagement with nut 30 while the upper end of reduced diameter portion 40 is externally threaded to receive nut 28.

The common axis of the threaded pin end and the first exterior portion 36 of the mandrel defines a first primary axis 50 which is coaxial with the axis of the downhole motor assembly while the axes of the outer cylindrical surfaces of reduced diameter portions 40 and 42, respectively, are machined such that their longitudinal axis is angularly offset from primary axis 50 so as to define a first secondary axis 56. The significance of this will become clear as the description proceeds. The mandrel defines a central fluid passageway 58 for conveying drilling fluid to the drill bit.

Bent sub housing 24 is a generally tubular member having an outer surface 60, whose diameter is the same as that of the motor housing and portion 36 of the mandrel, and a threaded downhole end 62 of reduced diameter threadedly engageable with the internally threaded bearing section 64 of the downhole motor. Housing 24 is formed with a pair of concentric internal surfaces 66 and 68 separated by conical shoulder 70 which is engageable with conical shoulder 44 of the mandrel which cooperate to limit telescopic movement in one axial direction of the bent sub housing with respect to the mandrel. Internal surfaces 66 and 68 of housing 24 are arranged receive the outer surfaces of reduced diameter portion 40 and 42 of the mandrel in sliding fit relation.

The axis of concentric cylindrical surfaces 66 and 68 define a second primary axis 72 while the axis of the threaded housing end 62 defines a second secondary axis 74 which is angular offset from the second primary axis. When housing 24 is assembled upon mandrel 22, the first primary axis is coaxial with the second primary axis so as to define a common axis about which the housing is rotatable when permitted to do so as explained later. The angular offset between the first primary and secondary axes and the second primary and secondary axes is nominally one degree but may range from a fraction of one degree to two degrees if desired. The magnitude of the offset angle is not important to the essence of the present invention. It will be seen, then, that the angular disposition of housing 24 with respect to mandrel 22 will determine the angular offset between the drill string and the drill bit. Maximum offset is obtained when the offset of the mandrel is in the same radial plane and extends in the same direction as that of the housing. This configuration is illustrated in FIG. 3*a*. Thus, if the angular offset is one degree, then the overall angular offset, i.e. between the axis of the drill string and the axis of the drill bit will be two degrees. This position is referred to as the "base" position. Minimum offset is obtained when the offset of the mandrel is in the same radial plane and extends in the opposite direction to that of the housing. This configuration is illustrated in FIG. 3*b*. This occurs when the housing is angularly displaced from the base position by 180 degrees whereat the offset angle of the housing cancels the offset angle of the mandrel so that the net overall angular offset between the axis of the drill string and the axis of the drill bit will be zero degrees. In this position, there will be a slight radial offset of the axis of the drill string and that of the drill bit; however, the two axes will be parallel to one another. It will be understood that angular displacements about the common axis ranging from the zero degree base position (FIG. 3*a*) to the 180 degree position (FIG. 3*b*) will provide overall angular offsets ranging from a maximum of two degrees to a minimum of zero degrees.

As already mentioned, nut 30 threadedly engages threaded end 46 of the mandrel and is formed with a first annular shoulder 80 which bears against the bottom end 82 of the mandrel as well as a second annular shoulder 84 which bears against the extreme bottom end 86 of the housing. In this manner, nut 30 prevents axial downward displacement of the housing with respect to the mandrel, while permitting rotational movement of the housing about the mandrel, while shoulders 44 and 70 prevent upward displacement of the housing with respect to the mandrel.

Sleeve 26 provides the means by which rotary forces can be transmitted between the mandrel and the housing and, with nut 28, provide the means by which the housing can be angularly adjusted with respect to the mandrel as explained hereinbelow.

The upper end 100 of housing 24 and the lower end 102 of sleeve 26 are formed with mating teeth 106 forming dog clutch elements of a dog clutch generally designated by reference numeral 108. When the teeth, and, thus, the clutch are engaged, rotary forces can be transmitted between the sleeve and the housing. Conversely, when the sleeve is displaced axially away from the housing such that the teeth are not longer engaged, the housing will be free to rotate with respect to the mandrel. In this manner, the housing can be set to the desired position between the base position and the 180 degree position.

Nut 28 is formed with a shoulder 110 which is abuttingly engageable with the upper end 112 of sleeve 26 so that when nut 28 is threaded against the sleeve, the dog clutch is maintained in an engaged or locked position. Conversely, when the nut is threaded away from the sleeve a sufficient distance, the sleeve can be slid axially away from the mandrel to allow disengagement of the clutch and angular adjustment of the housing with respect to the mandrel.

In order to transmit rotary forces between the mandrel and housing, internal surface 120 of the sleeve is formed with splines 122 arranged to receive keys 124 located in keyways 126 of the mandrel. The splines extend to both ends of the sleeve to allow the sleeve to clear keys 124 in order to facilitate assembly and adjustment of the assembly.

Figure 5:
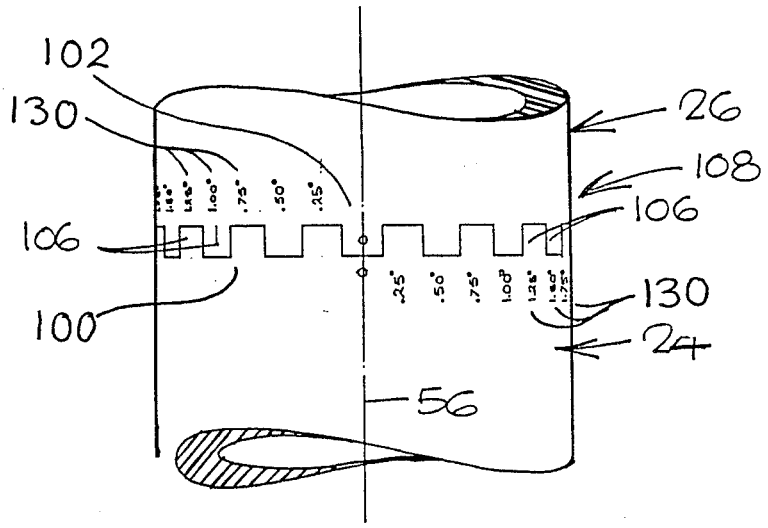
FIG. 5 is an enlarged view of indicia means disposed on the adjustable bent sub of the present invention for facilitating adjustment of the offset angle.

Advantageously, as best shown in FIG. 5, the sleeve and housing are each formed with alignable indicia 130 to facilitate positioning the housing in the proper and desired angular position with respect to the mandrel. As shown, the indicia may be in increments of 0.25 degrees and extend 180 degrees about the sleeve and housing. Further, the circumferential width of teeth 106 of the dog clutch may be arranged such that it corresponds to any desired angular increment, such as 0.25 degrees, for example, to facilitate positioning of the housing with respect to the mandrel.

The preferred location of bent sub in the drill string is between the motor section and bearing section of the downhole motor assembly. Prior to lowering the motor assembly into the borehole, the bent sub 20 is adjusted to provide the desired angular offset between the axis of the drill bit and the axis of the drill string. This is accomplished by loosening lock nut 28 and sliding sleeve 26 along keys 124 until mating dog clutch elements 106 are disengaged. Once the dog clutch is disengaged, housing 24 may be angularly adjusted with respect to mandrel 22 as previously explained.

Once the housing has been placed in the desired position, the dog clutch is re-engaged and nut 28 is threaded against sleeve 26 thereby securing sleeve 26 and mandrel 22 in the selected position.

It will be appreciated that the above described preferred embodiment of the present invention overcomes the disadvantages, discussed earlier, of the prior art. First, according to the present invention, it is unnecessary to manufacture and maintain a large inventory of a number of different bent subs. Second, the components of the bent sub of the present invention can be manufactured easily and accurately. Third, adjustment of the bent sub of the present invention is extremely simple and does not require removal of the bent sub.

It will be apparent to those skilled in the art that various modifications and alterations may be made to the above described embodiment without departing from the spirit of the invention as defined by the appended claims.

The embodiments of the invention in which an exclusive property or privilege is claimed are defined as follows:

1. An adjustable bent sub for use in directional drilling in earth formations, comprising:

(a) a first member having:
  i. a primary axis; and
  ii. external, cylindrical surface means defining a secondary axis disposed at a predetermined offset angle with respect to said primary axis;

(b) a tubular second member secured to said first member against axial displacement and having:
  i. a primary axis;
  ii. internal, cylindrical surface means defining a secondary axis disposed at a predetermined offset angle with respect to said second member primary axis, said internal surface being adapted to telescopically receive said first member external surface in sliding fit relation for rotation about said secondary axis; and
  iii. first clutch means extending axially from one end thereof;

(c) locking sleeve means telescopically receiving and non-rotatably coupled to said external surface means of said first member and having second clutch means extending axially of one end thereof toward said second member, said sleeve means being axially movable on said first member between an engaged position whereat said first and second clutch means are interengaged and non-rotatably couple said second member and said first member in a predetermined augular position and a disengaged position whereat said locking sleeve is axially displaced from said second member and said first and second clutch means are disengaged from one another so as to permit angular adjustment of said second member with respect to said first memeber; and (d) means threaded onto said external surface of said first member for securing said sleeve in said engaged position thereof.

2. An adjustable bent sub as defined in claim 1, said first and second clutch means being dog clutches having interengageable teeth.

3. An adjustable bent sub as defined in claim 2, said interengageable teeth defining a plurality of predetermined angular positions of said second member with respect to said first member.

4. An adjustable bent sub as defined in claim 1, said securing means comprising a tubular nut threaded onto said external, cylindrical surface means.

5. An adjustable bent sub as defined in claim 1, further including spline means for non-rotatably securing said locking sleeve to said external surface while permitting axial displacement of said locking sleeve with respect to said first member.

6. An adjustable bent sub as defined in claim 5, said spline means including alignable keyways formed in said external surface means and an internal surface of said locking sleeve and key means each extending between aligned keyways.

7. An adjustable bent sub as defined in claim 1, further including means for securing said first and second members in a predetermined axial position.

8. An adjustable bent sub as defined in claim 7, said securing means including cooperating shoulder means on said external and internal surface means for preventing axial displacement of said first and second members in one axial direction and nut means threaded onto one of said members and engageable with the other of said members for preventing axial displacement of said members in the opposite axial direction.

9. An adjustable bent sub for use in directional drilling in earth formations, comprising:

(a) a mandrel having:

i. a primary axis; and ii. external, cylindrical surface means defining a secondary axis disposed at a predetermined offset angle with respect to said primary axis, said surface means being stepped so as to define a first annular shoulder;

(b) a tubular bent sub housing having:

i. a primary axis;

ii. a stepped bore defining a secondary axis disposed at a predetermined offset angle with respect to said bent sub housing primary axis and a second annular shoulder engageable with said first annular shoulder for locating said first and second members in predetermined axial relationship, said bore being adapted to telescopically receive said mandrel external surface means in sliding fit relation for rotation about said secondary axis;

iii. dog first clutch teeth means extending axially from one end thereof; and (c) a first nut threaded onto said external surface means and engageable with an end of the bent sub housing for maintaining siad mandrel and said bent sub housing in said predetermined axial relationship;

(d) locking sleeve means telescopically receiving said external surface means, spline means for non-rotatably coupling said locking sleeve means to said external surface while permitting axial displacement of said sleeve means with respect to said mandrel, said sleeve means having second clutch means extending axially of one end thereof toward said first dog clutch means, said sleeve means being axially movable on said mandrel between an engaged position whereat said first and second clutch means are interengaged and non-rotatably couple said bent sub housing and said mandrel in predeteremined angular position and a disengaged position whereat said locking sleeve is axially displaced from said bent sub housing and said first and second clutch means are disengaged from one another so as to permit angular adjustment of said bent sub housing with respect to said mandrel; and (e) a second nut threaded onto said external surface of said mandrel for urging and maintaining said sleeve means in said engaged position.

* * * * *